United States Patent [19]

Councell

[11] 4,088,277

[45] May 9, 1978

[54] MULTIPLE LINER ROLL SUPPORT

[76] Inventor: Graham D. Councell, 8242 Brookgreen Rd., Downey, Calif. 90240

[21] Appl. No.: 661,482

[22] Filed: Feb. 26, 1976

[51] Int. Cl.[2] ..... B65H 19/06; B65H 19/10

[52] U.S. Cl. ..... 242/58.6; 242/85

[58] Field of Search ..... 242/58.6, 58.2, 58.4, 242/58, 58.1, 58.3, 86.7, 85, 78.6, 80

[56] References Cited

U.S. PATENT DOCUMENTS

| | | | |
|---|---|---|---|
| 1,828,898 | 10/1931 | Ball et al. | 242/58.2 |
| 2,000,809 | 5/1935 | Wood | 242/58.2 |
| 2,524,106 | 10/1950 | Hanson | 242/58.6 |
| 2,991,953 | 7/1961 | Moser et al. | 242/58.6 X |

*Primary Examiner*—George F. Mautz

*Attorney, Agent, or Firm*—William C. Babcock

[57] ABSTRACT

A power operated device for lifting first and second rolls of liner from the floor to elevated positions, and so rotatably supporting the rolls that they may be sequentially unwound and fed to a corregated paperboard making machine. As the liner of one of the rolls is being fed to the machine, the device may be pivoted to a position where a depleted roll may be removed therefrom and a new roll of liner mounted on the device. The device is also adapted to rotatably support two or more split rolls of liner to permit the liner to be concurrently fed to the corregated paperboard making machine.

4 Claims, 10 Drawing Figures

MULTIPLE LINER ROLL SUPPORT

BACKGROUND OF THE INVENTION

1. Field of the Invention

Multiple liner roll support.

2. Description of the Prior Art

In the past, stands have been used to rotatably support rolls of liner adjacent an end of a corregated paperboard making machine to permit liner to be fed into the latter. Rolls of liner weigh hundreds of pounds each, and when such stands are used the rolls must be hoisted into elevated rotatable positions thereon. Such an operation is not only time-consuming but also requires the expenditure of substantial physical energy.

The primary purpose in devising the present invention is to supply a multiple liner roll support that is power operated, permits rolls of liner to be raised from the floor to elevated rotatable positions, and by manipulation of the device a depleted roll of liner may be replaced by a new roll of liner as the other roll is having liner unwound therefrom and fed to the corregated paperboard making machine.

Another object of the invention is to supply a power operated device on which two or more split rolls of liner may be removably supported to have the liner therefrom concurrently fed to the corregated paperboard making machine.

SUMMARY OF THE INVENTION

The invention is a power operated device for use in rotatably supporting first and second rolls of liner adjacent an end of a corregated paperboard making machine to permit the first roll to be removed from the device after the liner thereon has been depleted, with the device during this removal operation supplying liner to the machine from the second roll, and the machine being supplied liner from the roll that replaced the first roll after the liner on the second roll has been depleted. During the time that liner is being supplied to the machine from the replacement roll, the depleted second roll is removed from the device and a second replacement roll is mounted thereon. In this manner a paperboard making machine may be continuously supplied with liner from either a first or a second roll, for as the liner on one roll is depleted the machine is supplied liner from the other roll.

The invention includes a base that has a pair of transversely aligned journal blocks supported in fixed positions thereon. A first shaft is rotatably supported in the journal block. A pair of inverted, triangular-shaped side plates that are laterally spaced a distance greater than the length of the longest roll of liner that will be supported on the device. The apex portions of the side plates are secured to the first shaft and extend upwardly therefrom. Each of the triangular shaped plates includes first and second angularly disposed side edges and the free ends of the side edges being connected by a third edge. The invention includes a power operated mechanism for concurrently pivoting the side plates in unison relative to the base. The side plates include supports for rotatably and removably engaging the first and second rolls to permit these rolls to rotate and sequentially feed liner to the machine. The power operated mechanism permits the pair of triangularly shaped side plates to pivot relative to the base to positions where such feeding is possible, as well as to allow the side plates to be pivoted to positions where either a first or second roll of liner may be engaged and raised from the floor to an elevated rotatable position.

DESCRIPTION OF THE PREFERRED EMBODIMENT

Figure 1:
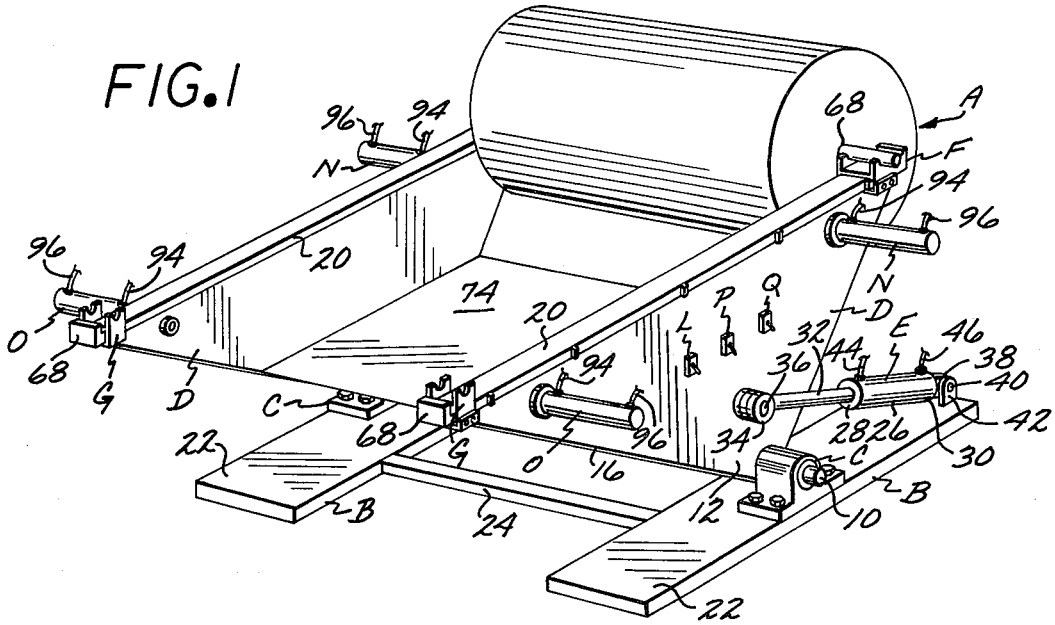
FIG. 1 is a perspective view of the multiple liner roll support.
Figure 2:
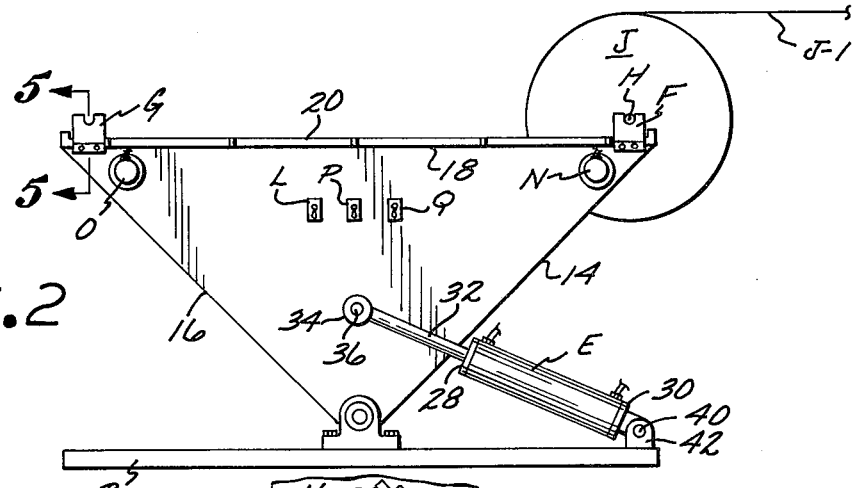
FIG. 2 is a side elevational view of the device shown in FIG. 1 in a first position, with liner being unwound from a first roll rotatably supported on the device.
Figure 3:
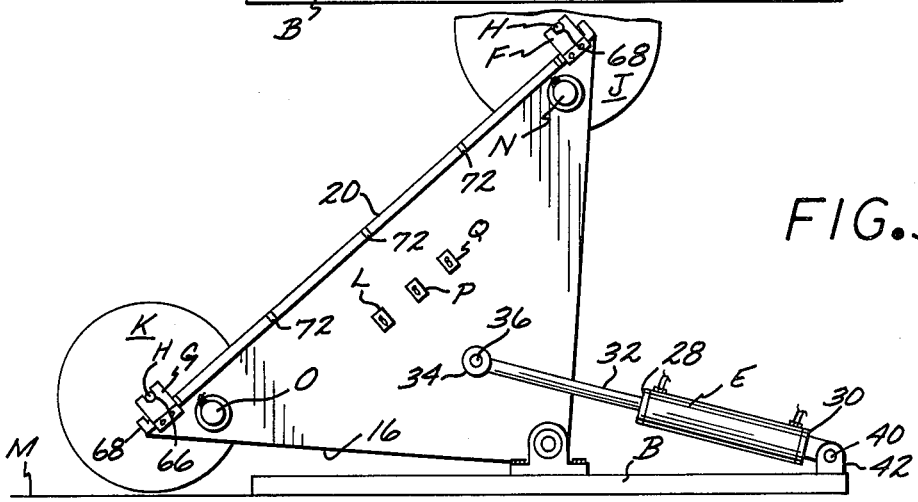
FIG. 3 is a side elevational view of the device shown in FIG. 1 in a second position, with a second roll being rolled from the floor onto the device to be subsequently elevated to a position where liner may be unwound therefrom and fed to a corregated paperboard making machine.
Figure 4:
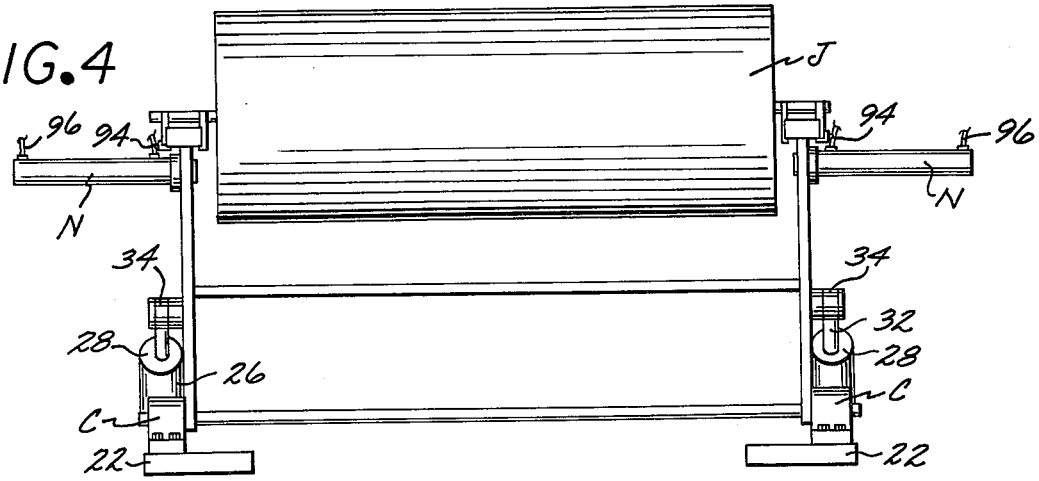
FIG. 4 is an end elevational view of the device.

The multiple liner roll support invention A, as may best be seen in FIGS. 1–3, inclusive, includes a base B that has a pair of laterally spaced and laterally aligned journal blocks C supported thereon. The invention A includes a pair of inverted, triangular, laterally spaced and laterally aligned side plates D. A first shaft 10 is rotatably supported in the journal block C and the apex portion 12 of the plates C are rigidly secured thereto. Each side plate D includes a first side edge 14, second side edge 16, which first and second side edges are angularly disposed relative to one another. The first and second side edges 14 and 16 at their free ends are connected by a third side edge 18.

The third side edge 18 has flanges 20 that extend the longitudinal length thereof and are secured to the third side edges either by being formed as an integral part of the side plates C or by being rigidly secured thereto by conventional means such as welding or the like. A pair of first power operated mechanisms E are provided which, when actuated, are adapted to concurrently pivot the side plates D relative to the base B. A pair of first carriages F and second pair of carriages G are movably supported on the flanges 20 for longitudinal movements relative to the latter. The first and second pairs of carriages F and G are each adapted to support transversely positioned second shafts H therebetween. The second shafts H, when so supported, are adapted to have first and second rolls J and K of liner mounted thereon as shown in FIG. 3.

The base B may take a number of forms, but is illustrated in FIG. 1 as being defined by two parallel laterally spaced heavy elongate strips 22 that are joined by a number of transverse cross pieces 24. One of the cross pieces 24 is illustrated in FIG. 1.

Each of the power operated mechanisms E, as may be seen in FIG. 1, includes a hydraulic cylinder 26 having a first end portion 28 and second end portion 30. A piston rod 32 is slidably mounted in the cylinder 26 and extends from the first end thereof. The piston rod 32 on the free end thereof has an eye 34 mounted thereon, which eye rotatably engages a stub shaft 36 that extends outwardly from the side plate D most adjacent to the piston rod 32. The second end portion 30 of the hydraulic cylinder E has a lug 38 projecting outwardly therefrom that is pivotally engaged by a transverse pin 40 that is supported between two laterally spaced brackets 42 secured to the base B.

Hydraulic fluid under pressure from a source (not shown) may be discharged into the interior of the hydraulic cylinder E adjacent the first end 28 thereof through a first conduit 44. Hydraulic fluid may likewise be discharged into the interior of the hydraulic cylinder E adjacent the second end thereof through a second conduit 46. The flow of pressurized hydraulic fluid into and out of the pair of hydraulic cylinders E through first and second conduits 44 and 46 is controlled by a first manually operated valve L that is preferably mounted on one of the pair of side plates D as shown in FIG. 1. The discharge of pressurized hydraulic fluid into and out of the pair of hydraulic cylinders E results in the pair of side plates D being pivoted to desired positions relative to the base B, one of the positions being illustrated in FIG. 3.

The first and second pairs of carriages F and G are of identical construction and only one of the second carriages G will be described in structural detail.

Figure 5:
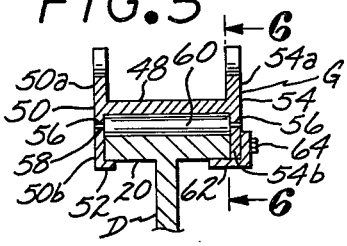
FIG. 5 is a fragmentary transverse cross-sectional view of the device taken on the line 5—5 of FIG. 2.
Figure 6:
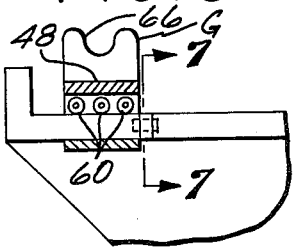
FIG. 6 is a fragmentary longitudinal cross-sectional view of the device taken on the line 6—6 of FIG. 5.

The carriage G, as may best be seen in FIGS. 5 and 6, includes a body that has a horizontal web 48 from which first and second flanges 50 and 54 extend upwardly and downwardly from opposite ends thereof. The first flange 50 includes an upper portion 50*a* and a lower portion 50*b*. The lower portion 50*b* has a lip 52 extending under an edge portion of flange 20. The second flange 54 includes an upper portion 54*a* and lower portion 54*b*. Aligned openings 56 are formed in the lower portions 50*b* and 54*b*, as shown in FIG. 5, and are engaged by third shafts 58. Each third shaft 58, as best seen in FIG. 6, includes a roller 60 that rests on the upper surface of flange 20. The lower portion 54*b* of second flange 54 has an L-shaped clip 62 secured thereto by a bolt 64 or other suitable fastening means. By removing the clip 62, the carriage G may be removed from the supporting flange 20.

The upper portions 50*a* and 54*a* of each carriage G has a downwardly extending groove 66 formed therein that serves to removably support one of the end portions of the second shaft G. The flanges 20, as may best be seen in FIG. 1, have stops 68 mounted on opposite ends thereof, to prevent the first and second carriages F and G being inadvertently displaced from the flanges. Each of the first and second rolls of liner J and K has a centrally disposed opening 68 that extends longitudinally therethrough, with this opening normally being defined by a cylindrical shell (not shown).

Figure 7:
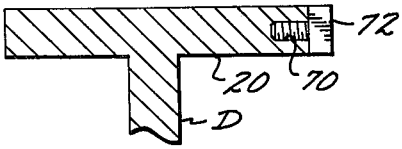
FIG. 7 is a transverse cross-sectional view of a portion of the device taken along the line 7—7 of FIG. 6.

Each of the flanges 20, as may best be seen in FIGS. 1 and 7, have a number of longitudinally spaced tapped bores 70 formed therein that may be threadedly engaged by bolts 72, which bolts serve as stops to prevent longitudinal movement of the first and second carriages F and G after they have been disposed at a desired position on the flanges 20. In FIG. 2 it will be seen that the multiple liner roll support A has been adjusted to a first position where liner J-1 may be unwound from the first roll J that is rotatably supported on the invention A on a second shaft H that extends between the first carriages F.

Figure 8:
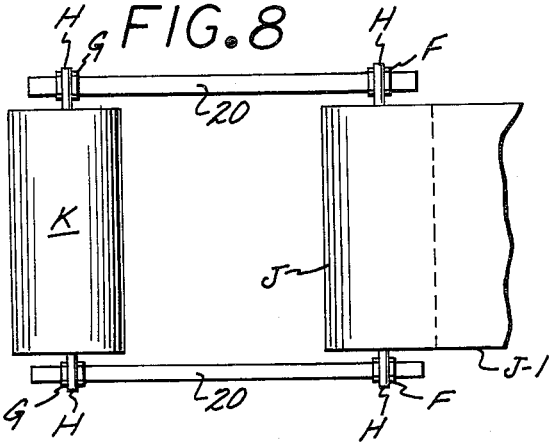
FIG. 8 is a top plan view of the device with a liner being unwound from a first roll rotatably supported thereon.
Figure 9:
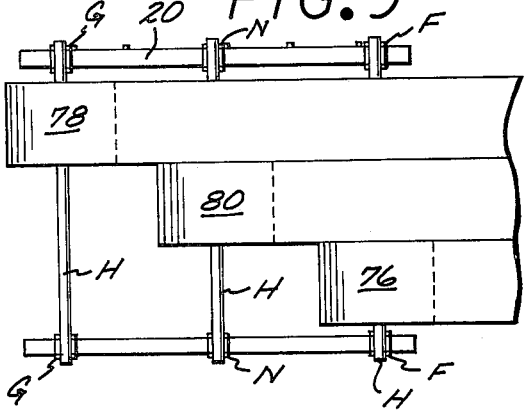
FIG. 9 is a top plan view of the device illustrating three split liner rolls rotatably supported to have liners concurrently unwound therefrom and fed to a corregated paperboard making machine.

In FIG. 2 it will be seen that the invention A has been disposed in a first position where liner J-1 may be unwound from the first roll J and the liner J-1 being directed to a corregated paperboard making machine (not shown). In FIG. 3, the invention A has been pivoted to a second position where liner J-1 may still be fed from the first roll J to the corregated paperboard making machine as a second roll of liner K is rolled along the floor M to a position where a shaft H may be extended therethrough, and the shaft disposed in a pair of the grooves 66 on the second pair of carriages G. By utilizing the power operated mechanism E, the side plates D may be disposed in a second position (not shown), where the first roll J that has been substantially depleted is adjacently disposed to the floor M, and the second roll K is at an elevated position where liner from the second roll K may be fed to the corregated paperboard making machine. During the time that the liner from the second roll K is being fed to the corregated paperboard making machine, the depleted roll J is removed from the invention and replaced by a new roll that engages the second shaft H that is removably supported in the grooves 68 of the first pair of carriages F. In FIGS. 5, 7 and 8, it will be apparent that by removing the bolts 64, either the first or second carriages F and G may be disposed at desired longitudinal positions on the channels 20 to support the first and second rolls of liner J and K. In FIG. 9 it will be seen that a third pair of carriages N is mounted on the flanges 20 and this third pair being identical in structure to the first and second pairs of carriages F and G. By aligning the first, second and third pairs of carriages F, G and N as shown in FIG. 9, a number of split rolls of liner 76, 78 and 80 may be rotatably supported from the invention A and liner fed concurrently from these rolls to the paperboard making machine (not shown). An alternate structure is shown in FIG. 1 which includes pairs of first and second hydraulic cylinders N and O that are secured to opposite end portions of the side plates D and project outwardly therefrom. The hydraulic cylinders N and O are of identical structure, and each includes a piston rod 82 that is slidable therein and extends through an opening (not shown) in the side plate D with which it is associated. Each piston rod 82 on the free end thereof supports a rotatable head 84 having a flange 86 and a conical portion 88 that extends forwardly from the flange. The first and second pairs of hydraulic cylinders N and O have first and second end portions 90 and 92. The first end portions 90 are removably secured to the pairs of side plates D by conventional means. When pressurized fluid is discharged into and out of the hydraulic cylinders N and O through first and second conduit 94 and 96, the piston rods 82 may be moved inwardly or outwardly relative to the first and second rolls of liner J and K, with the piston rods 82, when moving inwardly or outwardly relative to the first and second rolls of liner J and K, with the piston rods 82 when moving inwardly towards one another, disposing the conical portions 88 in the end portion of a cylindrical core (not shown) that extends through the rolls of liner J or K that are to be rotatably supported on the invention A.

Figure 10:
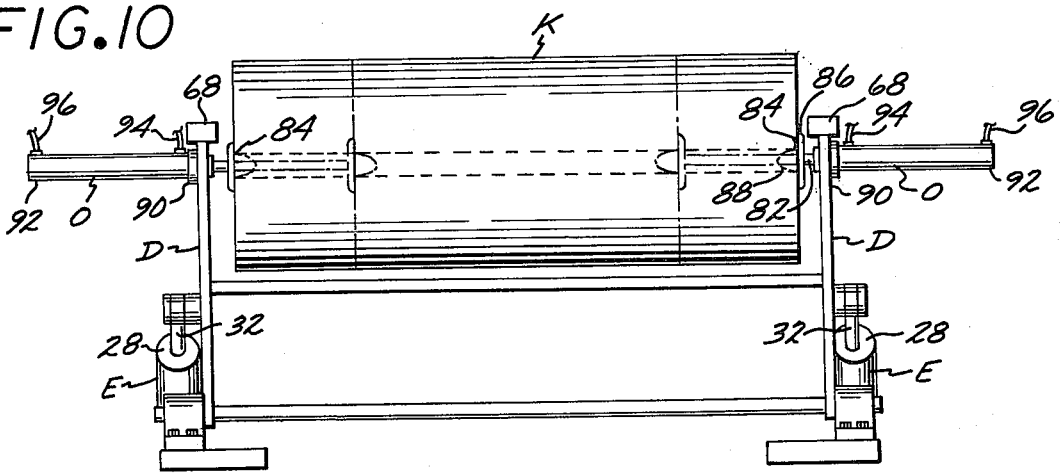
FIG. 10 is an end elevational view of the device.

In FIG. 10 it will be seen that the rotatable heads 84 may removably engage the ends of a roll of liner K substantially the length of the spacing between the pair of side plates D or a roll that is of substantially less length that is illustrated by phantom line in this figure. Control of pressurized hydraulic fluid from a source (not shown) to actuate the first pair of hydraulic cylinders N is controlled by a manually operated valve P that is preferably mounted on one of the side plates D as shown in FIG. 1. Likewise, control of the discharge to and from the second pair of hydraulic cylinders O through the first and second conduits 96 from a source of hydraulic fluid under pressure (not shown) is by means of a third manually operated valve Q, which valve is also preferably mounted on one of the side plates D adjacent the first and second valves L and P. By actuating the first and second hydraulic cylinders N and O in conjunction with the first power mechanism E, first and second rolls of liner J and K may be removably and rotatably supported on the invention, and the invention, disposed to have liner from one of the rolls, fed to the corregated paperboard making machine (not shown) as the other depleted roll on the invention is being replaced by a second roll that is rolled along the floor to a position where it may be engaged by a pair of the rotatable heads 84. The modified form of the invention that utilizes the first and second pairs of hydraulic cylinders N and O operate in substantially the same manner as the form of the invention first described, but in a more convenient manner.

The use and operation of the two forms of the invention have been described previously in detail and need not be repeated.

I claim:

1. A power operated device for use in rotatably supporting first and second rolls of liner adjacent an end of a corrugated paperboard making machine for supplying liner to the latter in such a manner that as said first roll is depleted a liner is supplied to said machine from said second roll, and said device as it supplies liner to said machine from said second roll capable of being manipulated to have said first roll that has been depleted removed therefrom and replaced by a first replacement roll, said device when said second roll has been depleted capable of being manipulated to have said second roll removed therefrom and replaced by a second replacement roll, and said power operated device as it is manipulated capable of lifting said first and second rolls of liner and first and second replacement rolls of liner from a floor supporting said device to positions where they may rotate and said liner thereon fed to said machine, and said device in addition capable of rotatably supporting at least three split rolls when the occasion so requires, said device including:

a. a base;

b. a pair of transversely aligned journal blocks supported on said base;

c. a first shaft rotatably supported in said journal blocks;

d. a pair of inverted triangular shaped side plates that are laterally spaced a distance greater than the length of one of said rolls, each of said plates including an apex portion that has first and second angularly disposed side edges extending therefrom, a third edge that extends between the free ends of said first and second edges, and said apex portions of said side plates rigidly secured to said first shaft;

e. first means that are power operated for pivoting said side plates in unison relative to said base;

f. second means that are power-operated and supported from said side plates for removably engaging the ends of longitudinal openings in said first and second rolls and first and second replacement rolls of liner to rotatably support said rolls of liner in elevated positions where liner may be sequentially unwound therefrom, and delivered to said machine, and said first means capable of pivoting said pair of side plates relative to said base where said first and second rolls and first and second replacement rolls may be engaged and disengaged from said second means;

g. a pair of flanges that extend longitudinally on the sides of said plates most remote from said apexes;

h. at least three pairs of transversely aligned, longitudinally spaced carriages movably supported on said flanges; and i. at least three shafts, with each of said shafts extending transversely between one of said pairs of carriages, and each of said shafts capable of rotatably supporting one of said split rolls.

2. A device as defined in claim 1 in which said first means is hydraulically operated.

3. A device as defined in claim 2 in which said first means includes:

g. a pair of first hydraulic cylinders having first and second ends, said pair of cylinders adjacently disposed to said pair of side plates and parallel thereto;

h. third means for pivotally supporting said first ends of said first hydraulic cylinders from said base;

i. a pair of first piston rods slidably mounted in said pair of first hydraulic cylinders and projecting from said second ends thereof;

j. fourth means for pivotally connecting said pair of first piston rods to said pair of side plates; and k. fifth means for concurrently supplying hydraulic fluid under pressure into and out of said first pair of hydraulic cylinders to pivot said pair of side plates to a desired position relative to said base.

4. A device as defined in claim 3 in which said second means includes:

l. two pairs of transversely aligned second hydraulic cylinders supported from said side plates adjacent said third edges thereof and extending outwardly therefrom, said second hydraulic cylinders having first and second ends, said second ends coaxially aligned with transverse openings in said side plates, and said second ends secured to said pair of side plates;

m. two pairs of transversely aligned piston rods mounted in said two pairs of second hydraulic cylinders, said second piston rods and extending from said second ends thereof through said openings into the sapce between said pair of side plates;

n. sixth means rotatably mounted on said piston rods that may removably engage the ends of longitudinal openings in said first and second rolls of liner and said first and second replacement rolls of liner; and o. seventh means for selectively supplying hydraulic fluid under pressure to said two pairs of second hydraulic cylinders to move said sixth means into and out of pressure contact with said longitudinal openings, with said sixth means when in pressure contact with said longitudinal openings allowing said first and second rolls to rotate to have said liner unwound therefrom to supply said machine, and said sixth means when not in contact with said cores to have said rolls of liner associated therewith separated from said device and replaced by said first and second replacement rolls of liner.

* * * * *